US010037859B2

(12) United States Patent
Jin

(10) Patent No.: US 10,037,859 B2
(45) Date of Patent: Jul. 31, 2018

(54) OVER-TEMPERATURE PROTECTION METHOD, OVER-TEMPERATURE PROTECTION CIRCUIT AND LINEAR DRIVING CIRCUIT THEREOF

(71) Applicant: Silergy Semiconductor Technology (Hangzhou) LTD, Hangzhou, ZheJiang Province (CN)

(72) Inventor: Jin Jin, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 304 days.

(21) Appl. No.: 14/862,881

(22) Filed: Sep. 23, 2015

(65) Prior Publication Data

US 2016/0111236 A1 Apr. 21, 2016

(30) Foreign Application Priority Data

Oct. 20, 2014 (CN) ..... 2014 1 0557470

(51) Int. Cl.
*H01H 37/32* (2006.01)
*G05F 1/569* (2006.01)

(52) U.S. Cl.
CPC ..... *H01H 37/32* (2013.01); *G05F 1/569* (2013.01)

(58) Field of Classification Search
CPC ..... H03K 2017/0806; H03K 17/0822; H02H 5/044; H02H 5/04; H02H 7/10; G06F 1/206; G01R 31/28; G05F 1/46; G05F 1/569; H01L 27/04; H01L 27/16; H05B 37/02; H02M 1/08; H01H 37/32
USPC ..... 361/103
See application file for complete search history.

(56) References Cited

U.S. PATENT DOCUMENTS 5,119,265 A * 6/1992 Qualich ..... H03K 17/08 323/907
6,078,511 A 6/2000 Fasullo et al.
6,867,573 B1 3/2005 Carper
7,301,745 B2 * 11/2007 Finney ..... H03K 17/0822 327/512
8,514,528 B2 8/2013 De Anna et al.
8,860,376 B2 * 10/2014 Kimura ..... H01M 10/443 320/150
2002/0113617 A1 * 8/2002 Gergintschw ..... H03K 17/0822 326/32

(Continued)

FOREIGN PATENT DOCUMENTS

CN 203376661 U 1/2014
CN 103428969 B 8/2015

OTHER PUBLICATIONS

Guangtian Gao, Application Technology of AD Converter, Jan. 2011, pp. 2-3,8, Figures 1,2-3, Science Press, China.

*Primary Examiner* — Thienvu Tran
*Assistant Examiner* — Nicolas Bellido
(74) *Attorney, Agent, or Firm* — Michael C. Stephens, Jr.

(57) ABSTRACT

A method of over-temperature protection for a power switch, can include: (i) generating a sensing signal by sensing a temperature of the power switch; (ii) determining a temperature threshold signal based on a conduction voltage between first and second terminals of the power switch, where a value of the temperature threshold signal is reduced as the conduction voltage increases; and (iii) turning off the power switch when the sensing signal is greater than or equal to the temperature threshold signal.

10 Claims, 6 Drawing Sheets

(56) References Cited

U.S. PATENT DOCUMENTS

| | | | | |
|---|---|---|---|---|
| 2005/0040803 | A1* | 2/2005 | Ueda | G05F 3/30 323/313 |
| 2008/0123238 | A1* | 5/2008 | Campos | G06F 1/3203 361/103 |
| 2010/0079197 | A1* | 4/2010 | Ladurner | H03K 17/0822 327/512 |
| 2010/0259313 | A1* | 10/2010 | Li | G01K 3/005 327/512 |
| 2011/0316606 | A1* | 12/2011 | Ladurner | H03K 17/14 327/378 |
| 2012/0229193 | A1* | 9/2012 | Ladurner | H03K 17/0822 327/512 |

* cited by examiner

OVER-TEMPERATURE PROTECTION METHOD, OVER-TEMPERATURE PROTECTION CIRCUIT AND LINEAR DRIVING CIRCUIT THEREOF

RELATED APPLICATIONS

This application claims the benefit of Chinese Patent Application No. 201410557470.8, filed on Oct. 20, 2014, which is incorporated herein by reference in its entirety.

FIELD OF THE INVENTION

The present disclosure generally relates to the field of power electronics, and more particularly to over-temperature protection circuits, linear driving circuits, and associated methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

SUMMARY

In one embodiment, a method of over-temperature protection for a power switch, can include: (i) generating a sensing signal by sensing a temperature of the power switch; (ii) determining a temperature threshold signal based on a conduction voltage between first and second terminals of the power switch, where a value of the temperature threshold signal is reduced as the conduction voltage increases; and (iii) turning off the power switch when the sensing signal is greater than or equal to the temperature threshold signal.

In one embodiment, an over-temperature protection circuit for a power switch, can include: (i) a temperature sensing circuit configured to output a sensing signal by sensing a temperature of the power switch; (ii) a temperature threshold signal generating circuit configured to generate a temperature threshold signal based on a conduction voltage between first and second terminals of the power switch, where a value of the temperature threshold signal is reduced as the conduction voltage increases; and (iii) a protection signal generating circuit configured to generate an over-temperature protection signal according to the sensing signal and the temperature threshold signal, where the over-temperature protection signal is activated to turn off the power switch when the sensing signal is greater than or equal to the temperature threshold signal.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

A power supply circuit can generate an output voltage for a load by controlling a power switch that is coupled between a power supply terminal and the load. When the load is reduced, a voltage may increase at a power switch that may be coupled in series with the load between the power supply terminal and ground. In this case, the power switch may suffer from power being too high, possibly resulting in a temperature increase of the power switch. The temperature may increase when the power increases, so the power switch may break down or otherwise be damaged when the temperature of the power switch increases to a threshold temperature.

Figure 1:
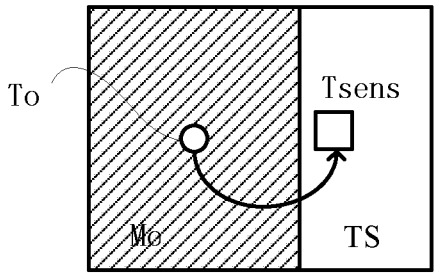
FIG. 1 is schematic diagram of an example temperature sensor for sensing the temperature of a power switch.

Referring now to FIG. 1, shown is schematic diagram of an example temperature sensor for sensing the temperature of a power switch. In this example, the temperature of a power switch can be sensed by placing a thermal sensor (TS) next to the power switch in the temperature sensing circuit. The power switch can be protected by controlling the power switch when temperature Tsens of the power switch reaches a certain threshold temperature. Because the temperature sensor cannot be placed in the center of power switch Mo, sensed temperature Tsens may be sensed at an edge of the power switch, and may not be used to precisely represent the power switch center temperature. Therefore, sensed temperature Tsens by such a temperature sensing circuit may typically be less than center temperature To of the power switch. Further, sensed temperature Tsens is farther from center temperature To as the distance between the temperature sensing circuit and the power switch increases. Thus in this case, the power switch may not be well protected because when sensed temperature Tsens reaches the predetermined threshold value, the power switch may have already broken down due to center temperature To of the power switch.

In some cases, the temperature sensing unit can be placed as close as possible to the center of power switch Mo, and thus the sensed temperature can better represent center temperature To of power switch Mo. However, this approach may be relatively difficult to implement in practical applications. Another approach can include detection of the conduction voltage of the power switch, and when the conduction voltage reaches a certain threshold value, the power switch can be latched off in order to protect the power switch from being damaged. Though inaccurate sensed temperature can be avoided in this case, the power switch may not be self-started, so the operation can be relatively complicated as the power switch may need to be started again after every such "latch-off."

In one embodiment, a method of over-temperature protection for a power switch, can include: (i) generating a sensing signal by sensing a temperature of the power switch; (ii) determining a temperature threshold signal based on a conduction voltage between first and second terminals of the power switch, where a value of the temperature threshold signal is reduced as the conduction voltage increases; and (iii) turning off the power switch when the sensing signal is greater than or equal to the temperature threshold signal.

Figure 2:
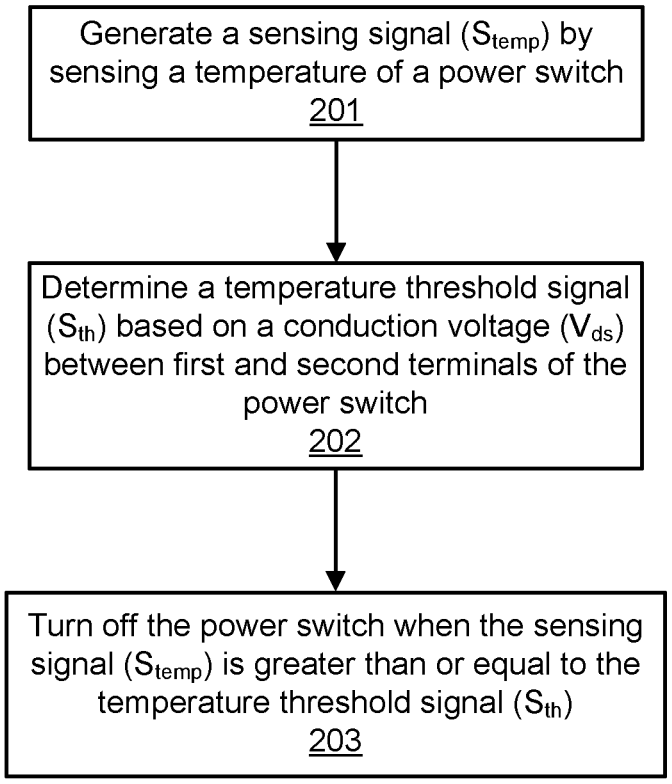
FIG. 2 is a flow diagram of a first example method of over-temperature protection for a power switch, in accordance with embodiments of the present invention.

Referring now to FIG. 2, shown is a flow diagram of a first example method of over-temperature protection for a power switch, in accordance with embodiments of the present invention. At 201, a temperature of a power switch can be sensed, and a sense signal that represents the current sensed temperature can be generated. In this particular example, sensed temperature Tsens can be obtained by sensing the temperature of the power switch, and by generating sense signal $S_{temp}$ therefrom to represent sensed temperature Tsens.

For example, the temperature of the power switch can be obtained by a temperature sensing unit, and sense signal $S_{temp}$ that represents sensed temperature Tsens may be a voltage signal. Thus, the sensed temperature generated by the sensor in the sensing unit can be converted to a voltage signal. At 202, a temperature threshold signal can be determined according to a conduction voltage between first and second terminals (e.g., the source and drain) of the power switch. For example, the temperature threshold signal (e.g., $S_{th}$) can decrease when the conduction voltage (e.g., $V_{ds}$) increases. Also, conduction voltage $V_{ds}$ between the first and second terminals of the power switch may be detected at the same, or substantially the same, time as the sensing of the temperature at 201.

In particular embodiments, a group of reference voltages that increase from reference voltage $V_{ds1}$ to nth reference voltage $V_{dsn}$ in a range determined by the minimum and maximum values of conduction voltage $V_{ds}$ between the first and second terminals of the power switch can be established. The n reference voltages can be selected in the range of conduction voltage $V_{ds}$ such that n reference voltages ($V_{ds1}$ . . . $V_{dsn}$) form a group of voltages between the minimum and maximum values of conduction voltage $V_{ds}$. For example, each of reference voltages can be set according to specific circuit parameters of the power switch.

After setting reference voltage $V_{ds1}$ through nth reference voltage $V_{dsn}$, a group of (n+1) threshold reference signals that gradually decrease from threshold reference signal $V_{th1}$ to (n+1)th reference signal $V_{th(n+1)}$ can be set. For example, reference voltage $V_{ds1}$ to nth reference voltage $V_{dsn}$, and threshold reference signal $V_{th1}$ to (n+1)th threshold reference signal $V_{th(n+1)}$ can be set according to reference voltage $V_{ds1}$ to nth reference voltage $V_{dsn}$. Various factors, such as thermal resistance, thermal capacitance, maximum withstand power of the power switch, as well as the heat conduction speed from the center temperature to the sensing unit, are among the factors to be taken into consideration when setting reference voltage $V_{ds1}$ through nth reference voltage $V_{dsn}$, and threshold reference signal $V_{th1}$ through (n+1) threshold reference signal $V_{th(n+1)}$.

In this way, a lower threshold reference signal can be set as the reference voltage is higher. When conduction voltage $V_{ds}$ of the power switch reaches a reference voltage, the power switch can be turned off when sense signal $S_{temp}$ equals a level of the reference voltage, in order to protect the main power switch from being broken down, or otherwise damaged. For example, when sense signal $S_{temp}$ that represents sensed temperature Tsens of the power switch is a voltage signal, a group of voltage signals from threshold reference signal $V_{th1}$ through (n+1) threshold reference signal $V_{th(n+1)}$ can be output as temperature threshold signal $V_{th}$ to be compared against sense signal $S_{temp}$. In this case, temperature threshold signal $S_{th}$ can use temperature threshold signal $S_{th}$.

Temperature threshold signal $S_{th}$ can be determined according to conduction voltage $V_{ds}$ of the power switch. For example, conduction voltage $V_{ds}$ can be determined by respectively comparing conduction voltage $V_{ds}$ against reference voltage $V_{ds1}$ through nth reference voltage $V_{dsn}$, and obtaining a sensing result. One of (n+1) threshold reference signals ($V_{th1}$, . . . $V_{th(n+1)}$) can be selected as temperature threshold signal $S_{th}$ according to conduction voltage $V_{ds}$. For example, threshold reference signal $V_{th1}$ can be selected as temperature threshold signal $S_{th}$ when conduction voltage $V_{ds}$ is less than threshold voltage $V_{ds1}$. The (i+1)th threshold reference signal $V_{th(i+1)}$ can be taken as temperature threshold signal $S_{th}$ when conduction voltage $V_{ds}$ is greater than ith reference voltage $V_{dsi}$, and less than or equal to (i+1)th reference voltage $V_{ds(i+1)}$, where n and i are positive integers. The (n+1)th threshold reference signal $V_{th(n+1)}$ can be taken as temperature threshold signal $S_{th}$ when conduction voltage $V_{ds}$ is greater than nth threshold voltage $V_{dsn}$.

At 203, the power switch can be controlled to be turned off when the sensing signal is greater than or equal to the temperature threshold signal. Sense signal $S_{temp}$ can be compared against temperature threshold signal $S_{th}$. When sense signal $S_{temp}$ is greater than or equal to temperature threshold signal $S_{th}$, the power switch can be turned off to achieve over-temperature protection. For example, the power switch can be a transistor (e.g., a MOS transistor) with the first and second terminals being the source/drain electrodes (e.g., the first terminal being the drain, and the second terminal being the source).

When over-temperature protection is provided to the power switch according to sensed temperature Tsens, a temperature threshold signal $S_{th}$ matching with conduction voltage $V_{ds}$ can be determined according to conduction voltage $V_{ds}$ of the power switch. For example, temperature threshold signal $S_{th}$ can decrease as conduction voltage $V_{ds}$ increases. Thus, over-temperature protection of the power switch can be achieved according to a comparison result of sense signal $S_{temp}$ and temperature threshold signal $S_{th}$. In this way, over-temperature protection of the power switch can be relatively timely and reliable considering the inherent error between sensed temperature Tsens and the center temperature To of the power switch.

As discussed above, whether the power switch will be broken in a particular case can be determined by the center temperature of the power switch. However, the edge temperature can be detected instead of the center temperature of the power switch, and the sensed temperature may be less than the center temperature, but not equal to the center temperature. Also, the power switch may suffer from higher power as the conduction voltage thereof becomes higher, so the center temperature of the power switch may also become higher. However, because of the limited heat conduction speed, the difference between the sensed temperature and the center temperature of the power switch may increase as the center temperature increases. Also, the power switch may suffer from higher power Po as the conduction voltage $V_{ds}$ thereof becomes higher, so the center temperature To of the power Po switch may also increase. Due to the limited heat conduction speed from the center of the power switch to the temperature conduction unit (e.g., the unit for sensing the temperature of the power switch), the sensed temperature may differ greatly from center temperature To of the power switch in some cases.

In this particular example, when conduction voltage $V_{ds}$ of the power switch increases, by selecting a lower temperature threshold signal $S_{th}$ to compare against sense signal $S_{temp}$, the power switch can be timely protected because sensed temperature Tsens may be far less than the actual center temperature To. In this way, the power switch can be timely protected with more reliable over-temperature protection, as compared to conventional approaches.

In one embodiment, an over-temperature protection circuit for a power switch, can include: (i) a temperature sensing circuit configured to output a sensing signal by sensing a temperature of the power switch; (ii) a temperature threshold signal generating circuit configured to generate a temperature threshold signal based on a conduction voltage between first and second terminals of the power switch, where a value of the temperature threshold signal is reduced as the conduction voltage increases; and (iii) a protection signal generating circuit configured to generate an over-temperature protection signal according to the sensing signal and the temperature threshold signal, where the over-temperature protection signal is activated to turn off the power switch when the sensing signal is greater than or equal to the temperature threshold signal.

Figure 3:
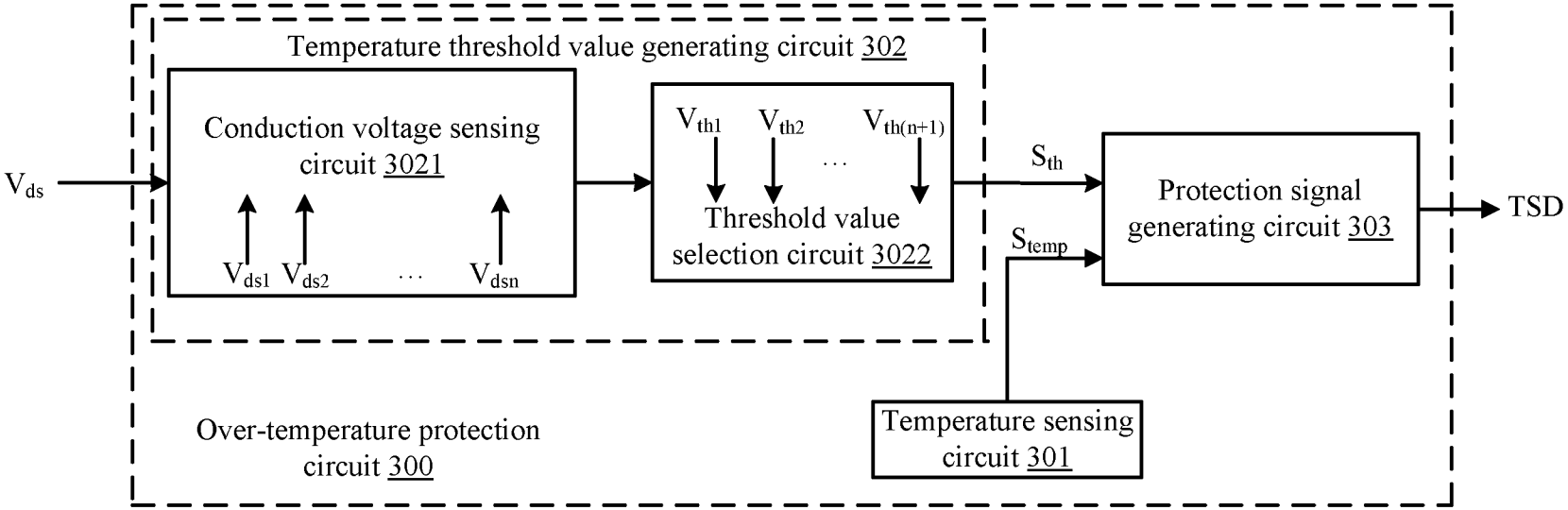
FIG. 3 is a schematic block diagram of a second example over-temperature protection circuit for a power switch, in accordance with embodiments of the present invention.
Figure 4:
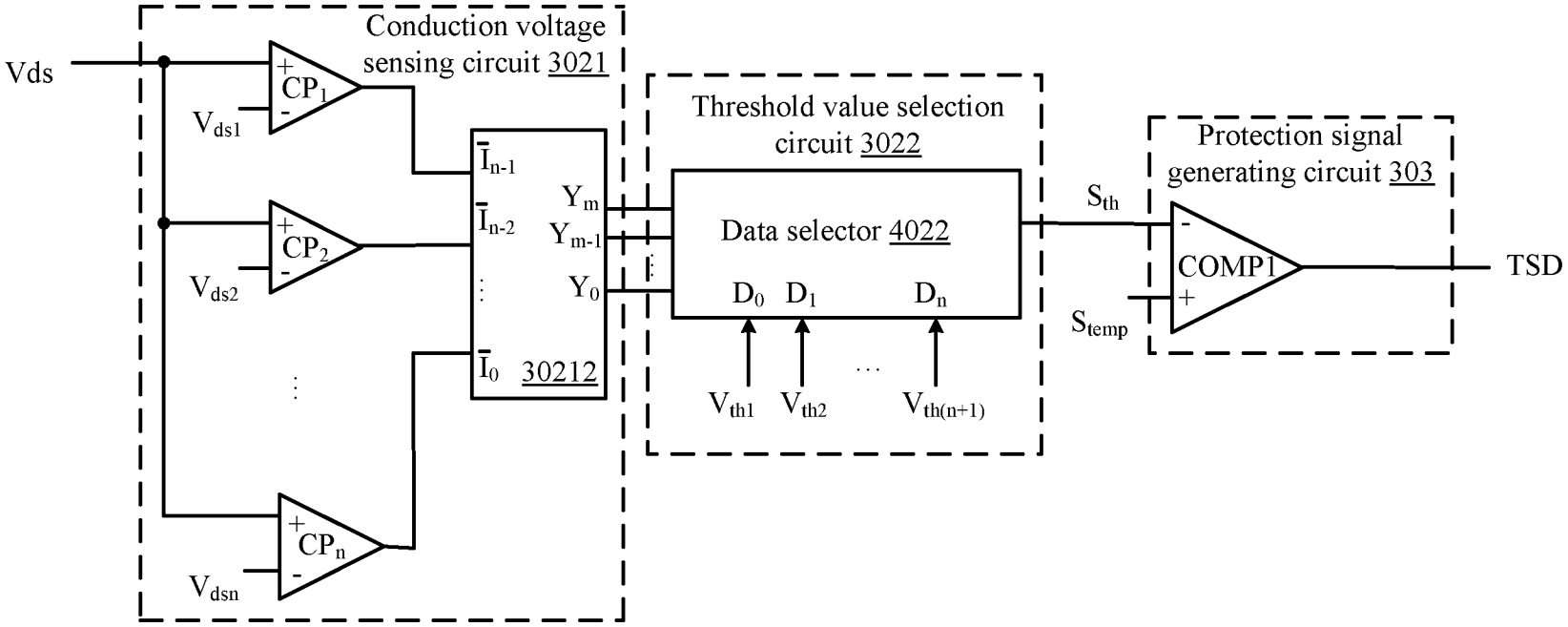
FIG. 4 is a schematic block diagram of more detailed circuitry of the example over-temperature protection circuit of FIG. 3, in accordance with embodiments of the present invention.

Referring now to FIGS. 3 and 4, shown are schematic block diagrams of a second example over-temperature protection circuit for a power switch, in accordance with embodiments of the present invention. The example of FIG. 3 can include temperature sensing circuit 301, temperature threshold signal generating circuit 302, and protection signal generating circuit 303. Temperature sensing circuit 301 can output sensing signal $S_{temp}$ by sensing a temperature of the power switch. For example, temperature sensing circuit 301 can include a temperature sensor or other appropriate circuitry in order to sense the temperature of the power switch.

Temperature threshold signal generating circuit 302 can generate temperature threshold signal $S_{th}$ according to conduction voltage $V_{ds}$ between first and second terminals of the power switch. The temperature threshold signal can become smaller as conduction voltage of power switch becomes larger. The two input terminals of protection signal generating circuit 303 can respectively connect to an output of temperature sensing circuit 301 and an output of temperature threshold signal generating circuit 302. Protection signal generating circuit 303 can generate over-temperature protection signal TSD according to sense signal $S_{temp}$ and temperature threshold signal $S_{th}$. For example, when sense signal $S_{temp}$ is greater than or equal to temperature threshold signal $S_{th}$, over-temperature protection signal TSD can go active to turn off the power switch.

In the example of FIG. 4, protection signal generating circuit 303 can be implemented by comparator COMP1. For example, comparator COMP1 may have an inverting input terminal, and a non-inverting input terminal for respectively receiving temperature threshold signal $S_{th}$ and sense signal $S_{temp}$. A comparison signal output by comparator COMP1 can be configured as over-temperature protection signal TSD. For example, when sense signal $S_{temp}$ is greater than temperature threshold signal $S_{th}$, a high level signal can be generated as an active over-temperature protection signal TSD in order to turn off the power switch.

In FIG. 4, temperature threshold signal generating circuit 302 can include conduction voltage sensing circuit 3021 and threshold value selection circuit 3022. Conduction voltage sensing circuit 3021 can receive conduction voltage $V_{ds}$ between the first and second terminals of the power switch, and threshold value selection circuit 3022 can connect to the output terminal of conduction voltage sensing circuit 3021. For example, conduction voltage sensing circuit 3021 can include n reference voltage sources for setting a group of n reference voltages that increase from reference voltage $V_{ds1}$ to nth reference voltage $V_{dsn}$. The n reference voltages may be in a group of voltages between the minimum and maximum values of the conduction voltage of the power switch, where n is a positive integer. Alternatively, n reference voltages can be provided by an external voltage source rather than conduction voltage sensing circuit 3021.

Threshold selection circuit 3022 can include (n+1) reference power supplies for setting a group of (n+1) threshold reference signals that decrease from threshold reference signal $V_{th1}$ to (n+1) threshold reference signal $V_{th}(n+1)$. For example, (n+1) reference power supplies can be (n+1) reference voltage sources for generating a group of voltage signals that increase from threshold reference signal $V_{th1}$ to (n+1) threshold reference signal $V_{th}(n+1)$. Alternatively, (n+1) reference threshold signals can be provided by an external power supply rather than threshold value selection circuit 302. Further, the threshold reference signal in this example may employ a voltage signal as temperature threshold signal $S_{th}$.

Reference voltage $V_{ds1}$ through nth reference voltage $V_{dsn}$, and threshold reference signal $V_{th1}$ through (n+1) threshold reference signal $V_{th(n+1)}$, can be set according to reference voltage $V_{ds1}$ through nth reference voltage $V_{dsn}$. Various factors, such as the thermal resistance, thermal capacitance, maximum withstand power of the power switch, as well as the heat conduction speed from the center temperature to the sensing unit can be taken into consideration when setting reference voltage $V_{ds1}$ through nth reference voltage $V_{thn}$, and threshold reference signal $V_{th1}$ through (n+1) threshold reference signal $V_{th(n+1)}$. Therefore, a smaller threshold reference signal $V_{th}$ can be set as the reference voltage increases such that when conduction voltage $V_{ds}$ of the power switch reaches a level of a reference voltage, the power switch can be turned off when sense signal Tsens equals the reference voltage, in order to protect the main power switch from being broken down.

Conduction voltage sensing circuit 3021 can respectively compare conduction voltage $V_{ds}$ against reference voltage $V_{ds1}$ through nth reference voltage $V_{dsn}$, and may output a sensing result that represents conduction voltage $V_{ds}$. Threshold value selection circuit 3022 can select one of threshold reference signal $V_{th1}$ to (n+1) threshold reference signal $V_{th(n+1)}$ as temperature threshold signal $S_{th}$ according to the sensing result. Threshold reference signal $V_{th1}$ generated by threshold value selection circuit 3022 can be taken as temperature threshold signal $V_{th}$ when conduction voltage $V_{ds}$ is less than threshold voltage $V_{ds1}$. Also, (i+1)th threshold reference signal $V_{th(i+1)}$ generated by threshold value selection circuit 3022 can be taken as temperature threshold signal $S_{th}$ when conduction voltage $V_{ds}$ is greater than ith reference voltage $V_{dsi}$ and less than or equal to (i+1)th reference voltage $V_{ds(i+1)}$. In addition, (n+1) threshold reference signal $V_{th(n+1)}$ generated by threshold value selection circuit 3022 can be taken as temperature threshold signal $S_{th}$ when conduction voltage $V_{ds}$ is less than threshold voltage $V_{th1}$.

Temperature threshold signal $S_{th}$ for comparing against sense signal $S_{temp}$ may be lowered as conduction voltage $V_{ds}$ increases, so as to reduce the inherent error between sensed temperature Tsens and center temperature To of the power switch, in order to timely protect the power switch with more reliable protection. In the example of FIG. 4, conduction voltage sensing circuit 3021 can be implemented by n comparators including comparator $CP_1$ through nth comparator $CP_n$. The input terminals of comparator $CP_1$ through nth comparator $CP_n$ can respectively receive conduction voltage Vds, and reference voltage $V_{ds1}$ through nth reference voltage $V_{dsn}$. Thus, the comparison signals generated by comparator $CP_1$ through nth comparator $CP_n$ may be configured as the sensing result that represents conduction voltage $V_{ds}$.

Conduction voltage sensing circuit 3021 can also include priority encoder 30212 having n input terminals respectively connected to comparator $CP_1$ through nth comparator $CP_n$ for receiving comparison signals generated by comparator $CP_1$ through nth comparator $CP_n$. In this way, an encoded digital signal that represents the sensing result can be generated, where the encoded digital signal includes the comparison signals generated by comparator $CP_1$ through nth comparator $CP_n$. Thus, threshold value selection circuit 3022 can generate appropriate temperature threshold signal $S_{th}$ according to the threshold reference signal.

For example, the encoded digital signal in FIG. 4 can be denoted by digital signals $Y_mY_{m-1} \ldots Y_1Y_0$, where $Y_0 \ldots Y_m$ can be "0" or "1". Data selector 4022 can be configured as threshold value selection circuit 3022, and the selection control terminal of data selector 4022 can receive the encoded digital signal generated by priority encoder 30212. Also, data input terminals (pin $D_0$, pin $D_1 \ldots$ pin $D_{(n-1)}$) can respectively receive threshold reference signal $V_{th1} \ldots$ (n+1)th threshold reference signal $V_{th(n+1)}$, and output terminals can provide temperature threshold signal $S_{th}$.

Figure 5:
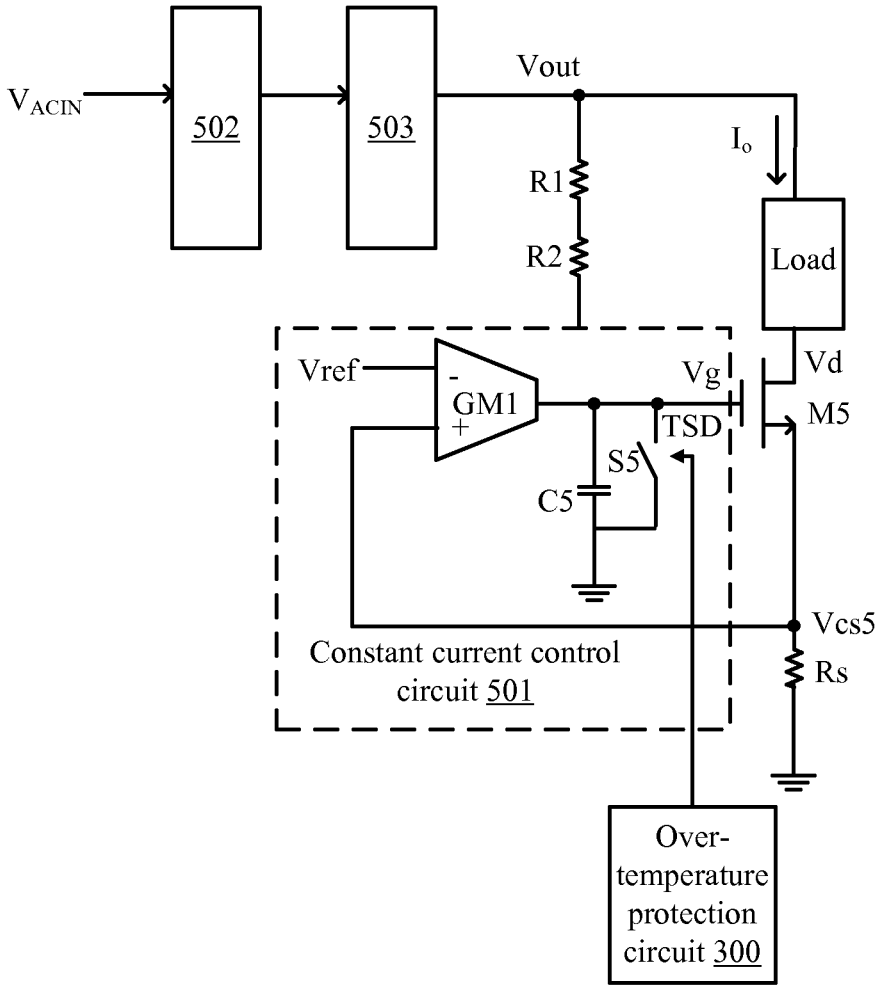
FIG. 5 is a schematic block diagram of an example over-temperature protection circuit in a linear driving circuit, in accordance with embodiments of the present invention.

Referring now to FIG. 5, shown is a schematic block diagram of an example over-temperature protection circuit in a linear driving circuit, in accordance with embodiments of the present invention. In this example, the over-temperature protection circuit 300 for a power switch can be applied with a linear driving circuit. The linear driving circuit can include a main power stage circuit with power switch M5 and over-temperature protection circuit 300 within the main power circuit. Power switch M5 may have a first terminal connected to DC voltage input terminal Vout of the linear driving circuit through a load, and a second terminal connected to ground through sampling resistor Rs. Also, a current flowing through the first terminal and second terminals of power switch M5 can be an output current of the linear driving circuit.

For example, the first terminal of power switch M5 can either be the source or drain electrode of power switch M5, and the second terminal can be the remaining source/drain electrode. Over-temperature protection circuit 300 can connect to the control terminal of power switch M5, and temperature threshold signal $S_{th}$ can be obtained according to conduction voltage $V_{ds}$ between the first and second terminals of power switch M5. Sense signal $S_{temp}$ may represent the temperature of power switch M5, and when sense signal $S_{temp}$ is greater than or equal to temperature threshold signal $S_{th}$, power switch M5 can be turned off. Also, temperature threshold signal $S_{th}$ can become smaller as conduction voltage $V_{ds}$ of power switch M5 increases. When sense signal $S_{temp}$ that represents sensed temperature Tsens of power switch M5 is greater than or equal to temperature threshold signal $S_{th}$, over-temperature protection circuit 300 outputs an active over-temperature protection signal TSD. This can be used to turn power switch M5 off to timely protect power switch M5.

For example, the linear driving circuit can include constant current control circuit 501 and sampling resistor Rs. Power switch M5 can connect between the negative pole of the load and a first terminal of sampling resistor Rs. The first terminal (e.g., drain) of power switch M5 can connect to the negative pole of the load, and the second terminal (e.g., source) of power switch M5 can connect to sampling resistor Rs. The positive pole of the load can connect to the voltage input terminal, and a second terminal of sampling resistor Rs can connect to ground. When power switch M5 is turned on, the output voltage of the power supply may be provided to the load, and sampling voltage Vcs5 that represents the output current can be obtained at the first terminal of sampling resistor Rs.

The input terminal of constant current controller 501 can connect to the first terminal of sampling resistor Rs for providing driving voltage Vg to the control terminal (e.g., gate) of power switch M5 to control power switch M5. Also, sampling voltage Vcs5 can be clamped to reference voltage Vref such that the current flowing through the load substantially equals a constant value Io=Vref/Rs. Here, the output of protection signal generating circuit 303 within over-temperature protection circuit 300 can connect to constant current controlling circuit 501. When sense signal $S_{temp}$ is greater than temperature threshold signal $S_{th}$, protection signal generating circuit 303 can activate over-temperature protection signal TSD such that constant current controlling circuit 501 can turn off power switch M5.

For example, constant current controlling circuit 501 can employ operational amplifier GM1. The inverting input terminal of operational amplifier GM1 can connect to the first terminal of sampling resistor Rs, and the non-inverting input terminal can receive reference voltage Vref. Sampling voltage Vcs5 may be substantially equal to reference voltage Vref when in a stable state. Also, compensation capacitor C5 can connect between the output of operational amplifier GM1 and ground, and the voltage across compensation capacitor C5 may be the driving voltage of power switch M5. When driving voltage is greater than the conduction threshold voltage of power switch M5, power switch M5 can be turned on, and the linear driving circuit may operate normally.

The output terminal of operational amplifier GM1 can connect to switching circuit S5 in parallel with compensation capacitor C5. Also, the control terminal of switching circuit S5 can connect to the output terminal of protection signal generating circuit 303 within over-temperature protection circuit 300. When sense signal $S_{temp}$ is greater than temperature threshold signal $S_{th}$, protection signal generating circuit 303 can activate over-temperature protection signal TSD to turn on switching circuit S5. In this case, the energy stored in compensation capacitor C5 may be released by switching circuit S5, and the voltage across compensation capacitor C5 may decrease. Then, power switch M5 may be turned off when the voltage across compensation capacitor C5 is reduced to a conduction threshold voltage of power switch M5.

Rectifier bridge circuit 502 and filter circuit 503 can be coupled ahead of the power stage circuit of the linear driving circuit. Rectifier bridge circuit 502 can include a plurality of rectifier diodes configured to convert an AC signal to a DC signal. Output voltage Vout provided to the load can be obtained by filtering the DC signal by filter circuit 503 connected between the output of rectifier bridge circuit 502 and the positive pole of the load. For example, a supply voltage of constant current controlling circuit 501 can be obtained by a bleed circuit including series-connected resistors R1 and R2 from the output terminal of filter circuit 503 such that a normal operating voltage can be provided to constant current control circuit 501. In this way, over-temperature protection for power switch M5 can be achieved by via the over-temperature protection circuit within the linear driving circuit.

In the linear driving circuit of FIG. 5, when the load is shortened or reduced, conduction voltage $V_{ds}$ between the two terminals of power switch M5 may be at a maximum. Also, conduction voltage $V_{ds}$ between the two terminals of power switch M5 may be substantially equal to a difference between output voltage Vout and sampling voltage Vcs5. Thus, the maximum value of conduction voltage $V_{ds}$ of power switch M5 may be Vout−Vcs5. As such, n reference voltages for power switch M5 can be increasingly set from 0 to Vout−Vcs5.

Figure 6:
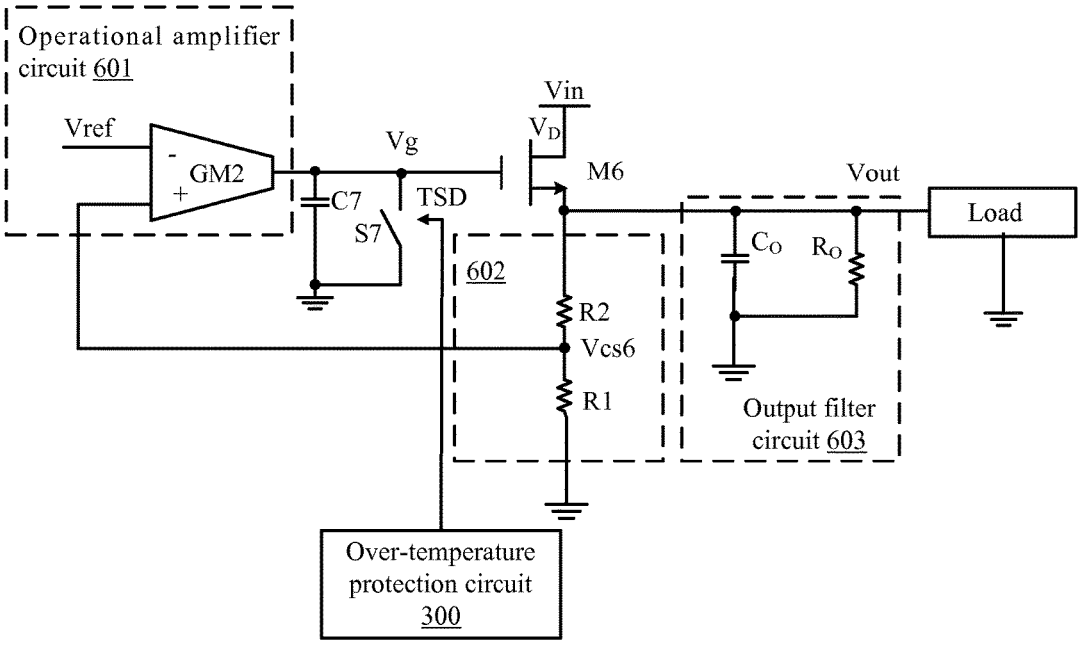
FIG. 6 is a schematic block diagram of another example over-temperature protection circuit in a linear driving circuit, in accordance with embodiments of the present invention.

Referring now to FIG. 6, shown is a schematic block diagram of another example over-temperature protection circuit in a linear driving circuit, in accordance with embodiments of the present invention. In this particular example, power switch M6 may have a first terminal connected to DC voltage input terminal Vin, and a second terminal connected to ground through output feedback circuit 602. Also, voltage Vout at the second terminal of power switch M6 can be configured as the output voltage of the linear driving circuit. For example, the first terminal of power switch M6 can either be the source or the drain of power switch M6, and the second terminal can be the remaining of the source/drain electrodes.

Over-temperature protection circuit 300 can connect to the control terminal of power switch M6. Temperature threshold signal $S_{th}$ may be obtained according to a conduction voltage between the first terminal (e.g., drain) and the second terminal (e.g., source) of the power switch M6, so as to obtain sense signal $S_{temp}$ that represents the temperature of power switch M6. When sense signal $S_{temp}$ is greater than or equal to temperature threshold signal $S_{th}$, power switch M6 may be turned off. Temperature threshold signal $S_{th}$ may become smaller as conduction voltage $V_{ds}$ of main power switch M6 increases.

The linear driving circuit can include operational amplification circuit 601 and output feedback circuit 602. Operational amplification circuit 601 can be implemented by operational amplifier GM2, and output feedback circuit 602 can include series-connected resistors R1 and R2. The first terminal (e.g., drain) of power switch M6 can connect to the voltage input terminal, and the second terminal (e.g., source) can connect to ground through series-connected resistors R1 and R2. When power switch M6 is turned on, input voltage Vin may provided to the load via the source of power switch M6. A common node of resistors R1 and R2 can be configured as a feedback output terminal of output feedback circuit 602, and sense/sampling voltage Vcs6 that represents the output voltage may be obtained at the common node.

The non-inverting input terminal of operational amplifier GM2 can connect to a common node of resistors R1 and R2 for receiving sense voltage Vcs6. The inverting input terminal of operational amplifier GM2 can receive a predetermined reference voltage Vref. The output terminal of operational amplifier GM2 can connect to the control terminal of power switch M6 through a grounded compensation capacitor C6. By applying operational amplifier GM2, sense voltage Vcs6=Vref when the circuit enters a stable state, so as to clamp output voltage Vout at a stable voltage to generate a substantially constant output. Also, the driving voltage of power switch M6 can be obtained across compensation capacitor C6 at the output terminal of the operational amplifier.

The output terminal of operational amplifier GM can connect to switching circuit S6 in parallel with compensation capacitor C6. The control terminal of switching circuit S6 can connect to the output terminal of protection signal generating circuit 303 within over-temperature protection circuit 300. When sense signal $S_{temp}$ is greater than temperature threshold signal $S_{th}$, protection signal generating circuit 303 may activate over-temperature protection signal TSD such that switching circuit S6 may be turned on. The energy stored in compensation capacitor C6 can be released by switching circuit S6, and voltage Vg across compensation capacitor C6 may decrease. Power switch M6 may be turned off when voltage Vg across compensation capacitor C5 is reduced to be lower than conduction threshold voltage of power switch M6.

For example, output filter circuit 603 can connect between the source of power switch M6 and ground, in order to filter output voltage Vout for the load. An RC output filter circuit can include filter capacitor Co and filter resistor Ro in this particular example of output filter circuit 603. Output filter circuit 603 provided at the output terminal can be helpful in improving the stability of the output voltage supplied to the load, in order to improve the output stability of the linear driving circuit. Over-temperature protection for power switch M6 may be achieved by applying over-temperature protection circuit 300 within the linear driving circuit as shown. In the linear driving circuit of this particular example, when the load is shortened or reduced, conduction voltage $V_{ds}$ between the first and second terminals of power switch M6 can be at a maximum, and conduction voltage $V_{ds}$ may be equal to the input voltage. Thus, the maximum value of conduction voltage $V_{ds}$ of power switch M6 can be Vin, and as such n reference voltages for power switch M6 can be increasingly set from 0 to Vin.

The embodiments were chosen and described in order to best explain the principles of the invention and its practical applications, to thereby enable others skilled in the art to best utilise the invention and various embodiments with modifications as are suited to particular use(s) contemplated. It is intended that the scope of the invention be defined by the claims appended hereto and their equivalents.

What is claimed is:

1. A method of over-temperature protection for a power switch, the method comprising:

a) generating a sensing signal by sensing a temperature of said power switch;

b) setting (n+1) threshold reference signals with decreasing values from a first threshold reference signal to an (n+1)th threshold reference signal;

c) selecting one threshold reference signal as a temperature threshold signal based on a conduction voltage between first and second terminals of said power switch, wherein a value of said temperature threshold signal is reduced as said conduction voltage increases; and d) turning off said power switch when said sensing signal is greater than or equal to said temperature threshold signal.

2. The method of claim 1, wherein said selecting said one threshold reference signal as said temperature threshold voltage comprises:

a) comparing said conduction voltage against each of a first reference voltage through an nth reference voltage in a plurality of reference voltages, wherein voltages in said plurality of reference voltages gradually increase from said first reference voltage to said nth reference voltage;

b) using said first threshold reference signal as said temperature threshold signal when said conduction voltage is less than said first threshold voltage;

c) using an (i+1)th threshold reference signal as said temperature threshold signal when said conduction voltage is greater than an ith reference voltage and less than or equal to an (i+1)th reference voltage, wherein n and i are positive integers and i is less than n; and d) using an (n+1)th threshold reference signal as said temperature threshold signal when said conduction voltage is greater than said nth reference voltage.

3. An over-temperature protection circuit for a power switch, comprising:

a) a temperature sensing circuit configured to generate a sensing signal by sensing a temperature of said power switch;

b) a temperature threshold signal generating circuit configured to generate (n+1) threshold reference signals with decreasing values from a first threshold reference signal to an (n+1)th threshold reference signal, and to select one threshold reference signal as a temperature threshold signal based on a conduction voltage between first and second terminals of said power switch, wherein a value of said temperature threshold signal is reduced as said conduction voltage increases; and c) a protection signal generating circuit configured to generate an over-temperature protection signal according to said sensing signal and said temperature threshold signal, wherein said over-temperature protection signal is activated to turn off said power switch when said sensing signal is greater than or equal to said temperature threshold signal.

4. The over-temperature protection circuit of claim 3, wherein said temperature threshold signal generating circuit comprises:

a) a conduction voltage sensing circuit configured to receive said conduction voltage, and to compare said conduction voltage against each of a plurality of reference voltages comprising a first reference voltage through an nth reference voltage, and to generate a sensing result; and b) a threshold selection circuit coupled to an output of said conduction voltage sensing circuit, and being configured to generate said temperature threshold signal according to said sensing result;

c) wherein said first threshold reference signal is configured as said temperature threshold signal when said conduction voltage is less than said first threshold voltage;

d) wherein an (i+1)th threshold reference signal is configured as said temperature threshold signal when said conduction voltage is greater than an ith reference voltage and less than or equal to an (i+1)th reference voltage, wherein n and i are positive integers and i is less than n; and e) wherein an (n+1)th threshold reference signal is configured as said temperature threshold signal when said conduction voltage is greater than said nth reference voltage.

5. The over-temperature protection circuit of claim 4, wherein said conduction voltage sensing circuit comprises a plurality of comparators comprising a first comparator through an nth comparator, wherein each of said plurality of comparators is configured to receive said conduction voltage at a first input terminal thereof and a corresponding of said plurality of reference voltages at a second input terminal thereof.

6. The over-temperature protection circuit of claim 5, wherein said conduction voltage sensing circuit further comprises a priority encoder having an input terminal coupled to output terminals of each of said plurality of comparators, and being configured to output an encoded digital signal that represents said sensing result.

7. The over-temperature protection circuit of claim 6, wherein said threshold selection circuit comprises a data selector having a selection terminal configured to receive said encoded digital signal, a digital input terminal configured to receive said plurality of threshold reference signals, and an output terminal configured to provide said temperature threshold signal.

8. A linear driving circuit, comprising the over-temperature protection circuit of claim 3, and further comprising said power switch having said first terminal coupled to a DC voltage input terminal of said linear driving circuit, and said second terminal coupled to ground, wherein a current flowing through said first and second terminals of said power switch comprises an output current of said linear driving circuit.

9. The linear driving circuit of claim 8, wherein said linear driving circuit further comprises:

a) a sampling resistor having a first terminal coupled to said second terminal of said power switch, and a second terminal coupled to ground; and b) a constant current control circuit configured to clamp a voltage at said first terminal of said sampling resistor to a predetermined voltage such that said output current is substantially maintained as a predetermined constant value, and to generate a driving voltage at a control terminal of said power switch to control said power switch.

10. The linear driving circuit of claim 8, wherein a voltage at said second terminal of said power switch comprises an output voltage of said linear driving circuit, and wherein said linear driving circuit further comprises:

a) an output feedback circuit having an input terminal coupled to said second terminal of said power switch, and being configured to provide a sense voltage that represents said output voltage; and b) an operational amplification circuit having a first input terminal coupled to said predetermined reference voltage, a second input terminal coupled to an output terminal of said output feedback circuit, and an output terminal coupled to said control terminal of said power switch.

* * * * *